US010876717B1

(12) United States Patent
Parker et al.

(10) Patent No.: US 10,876,717 B1
(45) Date of Patent: Dec. 29, 2020

(54) SYSTEM FOR ATTACHMENT AND REMOVAL OF LIGHT SEGMENTS

(71) Applicant: LUMINII LLC, Niles, IL (US)

(72) Inventors: Jeffery Parker, Northfield, IL (US); Laurentiu Vlad, Northfield, IL (US); Meng Yang, Buffalo Grove, IL (US); Sergey Lagonsky, Grayslake, IL (US)

(73) Assignee: LUMINII LLC, Niles, IL (US)

( * ) Notice: Subject to any disclaimer, the term of this patent is extended or adjusted under 35 U.S.C. 154(b) by 0 days.

(21) Appl. No.: 16/541,233

(22) Filed: Aug. 15, 2019

(51) Int. Cl.

| | |
|---|---|
| ***F21V 21/005*** | (2006.01) |
| ***F21S 4/28*** | (2016.01) |
| ***F21V 17/04*** | (2006.01) |
| ***F21V 23/06*** | (2006.01) |
| ***H05B 45/00*** | (2020.01) |

(52) U.S. Cl.
CPC ..... *F21V 21/005* (2013.01); *F21S 4/28* (2016.01); *F21V 17/04* (2013.01); *F21V 23/06* (2013.01); *H05B 45/00* (2020.01)

(58) Field of Classification Search
CPC ..... F21V 21/005; F21V 17/04; F21V 23/06; H05B 45/00; F21S 4/28
See application file for complete search history.

(56) References Cited

U.S. PATENT DOCUMENTS

| | | | | |
|---|---|---|---|---|
| 2008/0068830 | A1* | 3/2008 | Sharma | F21V 21/35 362/147 |
| 2010/0296285 | A1* | 11/2010 | Chemel | H05B 47/12 362/235 |
| 2015/0251594 | A1* | 9/2015 | Timm | B64D 11/00 362/471 |
| 2016/0033098 | A1* | 2/2016 | Bergman | F21S 2/005 362/418 |
| 2016/0033099 | A1* | 2/2016 | Bergman | F21S 8/046 362/236 |
| 2016/0154170 | A1* | 6/2016 | Thompson | B60Q 3/225 362/609 |

* cited by examiner

*Primary Examiner* — Kevin Quarterman
(74) *Attorney, Agent, or Firm* — Saul Ewing Arnstein & Lehr LLP

(57) ABSTRACT

A modular lighting system for attachment and removal of light sources is described herein. In one embodiment, the system may include a first LED light segment adapted or configured to produce ambient light, a second LED light segment adapted or configured to produce directional light, an installation track adapted or configured to connect to the first LED light segment and the second LED light segment along a length of the installation track, a power source adapted or configured to provide power, via the installation track, to the first LED light segment and the second LED light segment when the first LED light segment and the second LED light segment are connected to the installation track, where the first LED light segment and the second LED light segment are further adapted or configured to be separately controllable and positionable along the length of the installation track.

10 Claims, 8 Drawing Sheets

100

300

400

500-a 500-b

600

700

800

SYSTEM FOR ATTACHMENT AND REMOVAL OF LIGHT SEGMENTS

BACKGROUND OF THE INVENTION

Conventional lighting systems may allow for multiple light sources to be connected to one another. These systems may be designed in such a way so as to allow for a specified number and variety of lights to be connected to one another, for example a set of lights for use in a display case. The display lights may include different types of lighting, such as directional lighting to project light onto a particular item and ambient lighting to provide low-intensity lighting in an area. The display lights may be connected to each other through hardware, such as a light fixture.

However, these conventional lighting systems provide for either permanent placement of the lights, or else the systems provide for inefficient installation. In the above example of a conventional display case lighting system, the conventional system includes permanently installed lights to the fixture. Thus, once the fixture is installed, a user cannot mix and match different lighting types in different positions within the fixture. Following the same example, a user may attempt to remedy this situation by installing various power ports for connecting multiple light fixtures within a display case. However, this installation is extremely cumbersome and time consuming. A need exists for a lighting system that allows for easy detachment and removal of various types of light sources at various positions across the system.

SUMMARY

One aspect of the invention provides for a modular light system. In one embodiment, the system includes a first LED light segment adapted or configured to produce ambient light, a second LED light segment adapted or configured to produce directional light, an installation track adapted or configured to connect to the first LED light segment and the second LED light segment along a length of the installation track, a power source adapted or configured to provide power, via the installation track, to the first LED light segment and the second LED light segment when the first LED light segment and the second LED light segment are connected to the installation track, where the first LED light segment and the second LED light segment are further adapted or configured to be separately controllable and positionable along the length of the installation track.

This aspect of the invention can include a variety of embodiments.

In one embodiment, the first LED light segment further includes a diffuser, lens, or color filter. In one embodiment, the second LED light segment further includes a reflector, lens, or a diffuser.

In one embodiment, the modular light system further includes a sensor adapted or configured to sense a connection between the installation track and the first LED light segment, the second LED light segment, or both, and a controller adapted or configured to control a light output of the first LED light segment, the second LED light segment, or both, based on the sensed connection. In some cases, the sensor is further adapted or configured to sense a condition associated with the modular lighting system, and the controller is further adapted or configured to control the light output of the first LED light segment, the second LED light segment, or both, based on the sensed condition.

In one embodiment, the modular lighting system further includes a sensor adapted or configured to detect an individual within a predefined geographical range of the modular lighting system, and a controller adapted or configured to control a light output of the first LED light segment the second LED light segment, or both, based on the detected individual. In some cases, the modular light system can further include a processor, memory, and instructions executable by the processor to determine when the motion detector has detected motion, and log the detected motion in the memory. In some cases, the sensor can include a motion detector sound, ambient light detector, camera, etc. Furthermore, a light segment can be a sensor.

In one embodiment, the modular lighting system further includes a display case adapted or configured to couple to the installation track. In one embodiment, the first LED light segment, the second LED light segment, or both, are further adapted or configured to produce directable light. In one embodiment, the wherein the first LED light, the second LED light, or both, are further adapted or configured to connect magnetically to the installation track.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

A system for attachment and removal of light sources is described herein. The system may include an installation track with multiple locations for coupling a light segment onto a surface of the system. The light segment can include a light source, such as an ambient light source for emitting ambient light of a directional light source for emitting directional light. The installation track may include various locations in which to provide power to the light segments across the surface of the installation track, where power may be provided through an inductive source, for example. These various locations across the installation track surface may also provide for coupling means with which to attach the light segment to the surface of the installation track, such as with magnetic attraction or with a hook or clasp assembly snap, clip or a spring, for example. Further, the light segment may including a matching power receiver and a matching connection configuration as that of the various locations. When the light segment is placed on the surface of the system, the light segment connects to the installation track as well as receive power from the installation track, thereby emitting light. Thus, by simply placing the light segment in contact with the fixture, a user may easily mix and match different light segments based upon the user's needs, and may do so while exerting minimal time and effort.

Figure 1:
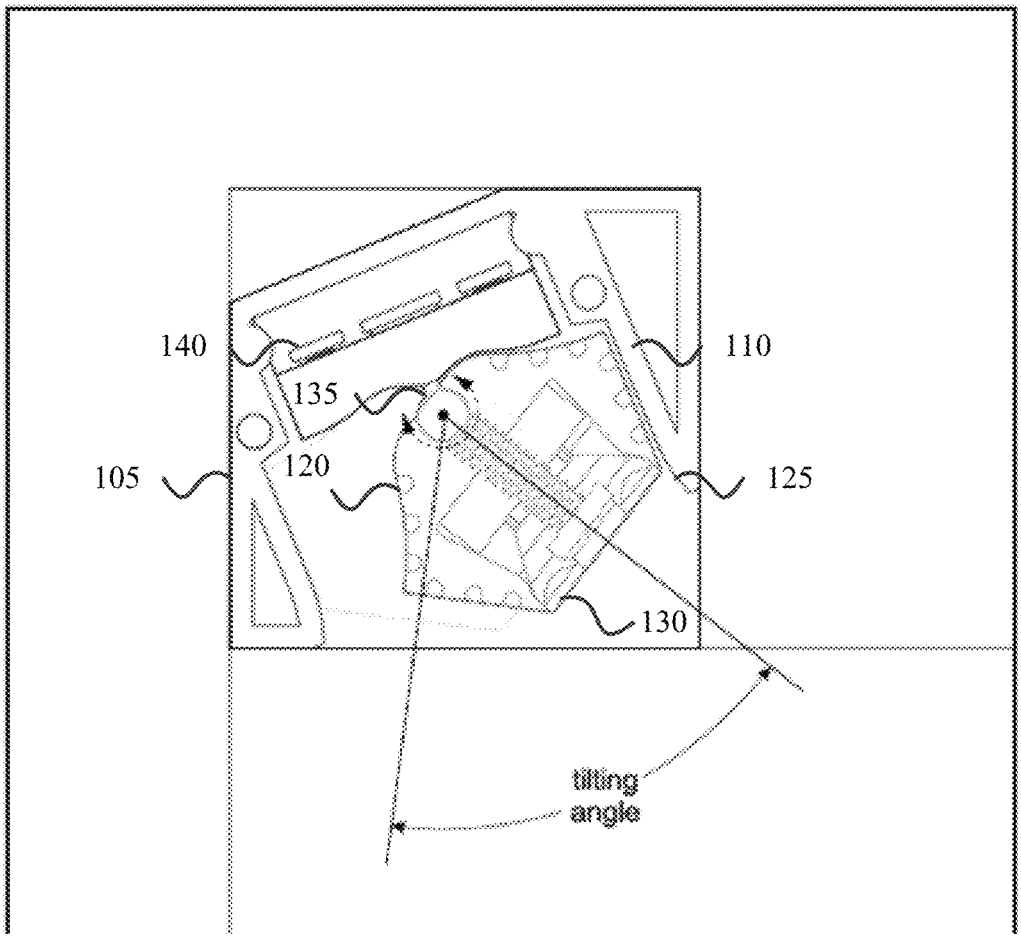
FIGS. 1 and 2 depict light segments for a modular lighting system for attachment and removal of light segments, according to embodiments of the claimed invention.

FIG. 1 illustrates a light segment 100 for use in an modular lighting system for attachment and removal of light sources, according to an embodiment of the claimed invention. The light segment 100 can include a light fixture 105, which provides a cavity for a light source.

The light fixture 105 can be composed of a rigid material such as a metal or metal alloy (examples of which include aluminum, cadmium, niobium, copper, gold, iron, nickel, platinum, silver, tantalum, titanium, zinc, zirconium, aluminum, cold rolled steel, stainless steel, brass, and the like), plastics (examples of which include acrylics, polycarbonates, polyethylene, urea formaldehyde, acrylonitrile butadiene styrene, aikyd resins, amino resins, epoxy resins, ethylene vinyl acetate, phenol formaldehyde, polyacetal, polyamide, polyesters, polyethylene, polymethyl methacrylate, polymethyl pentane, polyphenylene oxide, polyphenylene sulphide, polystyrene, polysulphone, polytetrafluoroethene, polyvinyl chloride, styrene acrylonitrile, and the like), or a combination thereof.

The light fixture 105 can also include a support structure 110. The support structure 110 can increase rigidity to the light fixture 105, and can also form and maintain the overall shape of the light fixture 105. In some cases, the support structure 110 can at least partially support the weight and positioning of a light source, such as light source 120, within the light fixture 105. Additionally, the support structure 110 can guide emitted light from the light source of the light segment 100. For example, the support structure 110 can include a reflecting surface 125, where light emitted from the light source 120 reflects off (e.g., is directed by) the reflecting surface towards a bottom opening of the light fixture 105. In other cases, the support structure 110 can include an absorbing surface, where light emitted from a light source is absorbed by the absorbing surface, thereby decreasing the intensity of the emitted light. In either case, the surface of the support structure 110 can be used to manipulate the emitted light, subsequently affecting the emitted light intensity and/or the direction (e.g., a light pattern) of the emitted light.

The light fixture 105 can house several different types of light sources. For example, the light source 120 can be a directional light, or an ambient light. An ambient light can be the source of ambient lighting from the light segment 100. For example, the light source 120 can include a light producing element configured to produce ambient lighting. In some cases, the light source 120 can include a diffuser or lens 130 configured to produce ambient lighting from a light producing element.

The light source 120 can alternatively be a directional light. The light source 120 can be a source of directional lighting from the light segment 100. For example, the light source 120 can include a light producing element configured to produce directional lighting. In some cases, the one or more lens or diffuser 130 of the light source 120 can be configured to produce directional lighting.

The light source 120 can also include a baffle (not shown) for securing the light source 120 within the light fixture 105. The baffle can be attachable and removable (e.g., via clips, a threaded socket, magnetic surfaces, etc.) from the light fixture 105, thereby allowing a user access to inner portions of the light source 120. As an example, a user can attach or remove the light producing element from the light source 120 subsequent to removing the baffle. In another example, the baffle is used to connect the light source 120 to the light fixture 105, so that removing the baffle allow the user to remove the light source 120 from the light fixture 105.

In some cases, the light source 120 can be coupled to a repositionable 135 structure in the cavity of the light fixture 105. The repositionable structure 135 can be used to reposition the light source 120, thereby changing the angle of projection of the emitted light from the light segment 100. In some cases, the repositionable structure 135 can be a ball-and-mount system, a pivot, or an adjustable means that allows for rotational or aimable movement by the light source 120 (e.g., up to 30 degrees of rotation). In some examples, the repositionable structure 135 can be a slide track system allowing for lateral movement of the light source 120. The repositionable structure 135 can allow for a user to manually direct the light from the light source 120 towards a desired location (e.g., at an art piece or a fashion piece on a shelf).

Many of the aspects of the light segment 100 can be interchangeable. For example, the light sources, the lens, the diffuser, the baffle, or a combination thereof, can be removed, replaced, or interchanged, from the light segment 100. This interchangeability can allow a user to format the light segment 100 based on user preferences or lighting requirements.

Various types of lighting can be used in the light segment 100. For example, the exemplary embodiments provided herein provide LED lighting as the light source 120. However, the light segment 100 can also include incandescent light, compact fluorescent (CFL) light, halogen light, metal halide light, high pressure sodium (HPS) light, low pressure sodium (LPS) light, phosphor-converted amber (PCA) light, narrow-band amber (NBA) light, laser lighting, fiber optic lighting, or a combination thereof. In some cases, the light segment can include a sensor (e.g., in lieu of, or in addition to, a light source), such as a heat sensor, an image sensor, a bio-information sensor, and the like.

The system can also implement dynamic lighting. Dynamic light can include, as examples, light dimming, changing colors of the light, multiple tracks with different channel, a reallocation of power between different light sources, an adjustment of light color a light source, or a combination thereof.

Figure 2:
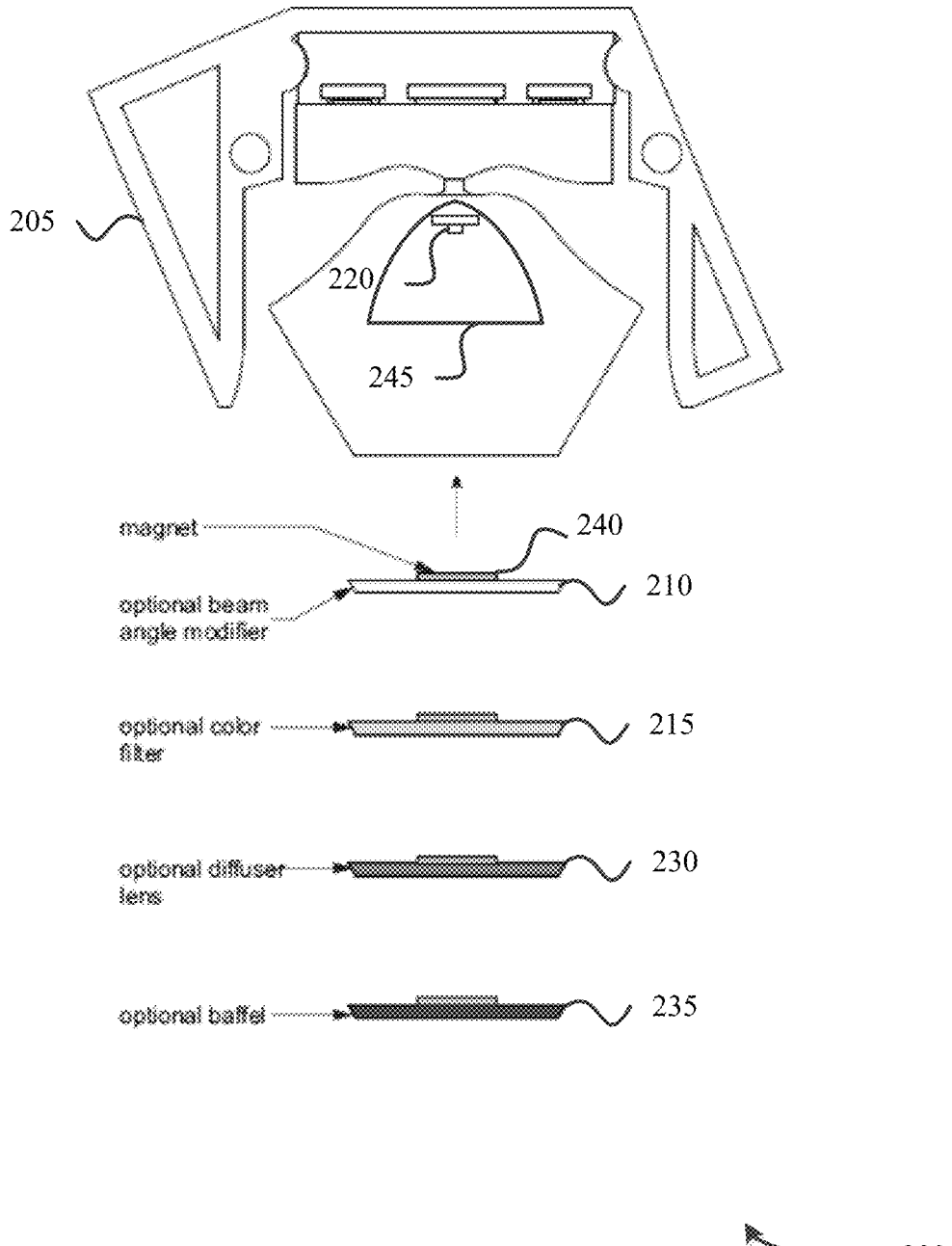
Figure 4:
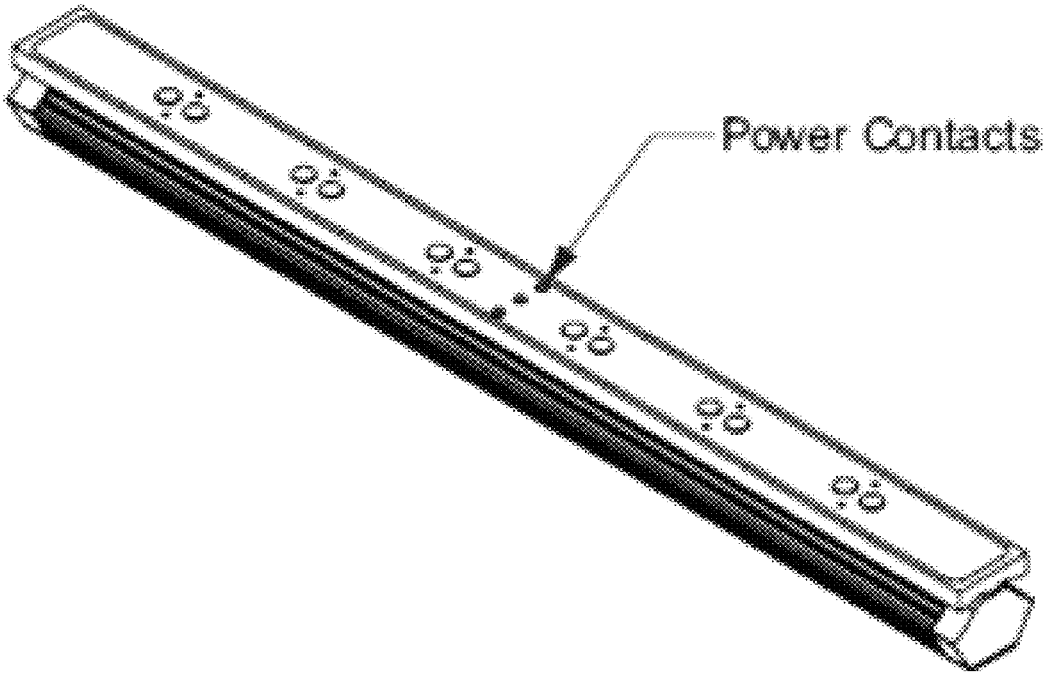
FIG. 4 depicts power contacts of a light segment for power reception of the light segment, according to an embodiment of the claimed invention.

The light fixture 105 can also include a power input 140 for providing power to the light segment 100. For example, the light fixture 105 can include pronged (e.g., male) connectors for receiving power (e.g., from a power mains). Pronged connectors connecting the light fixture 105 to an installation track are shown in FIG. 1. Alternatively, the light fixture 105 can include female connectors for receiving corresponding pronged connectors. In some cases, the light fixture 105 can include battery-operated power. Power may have multiple channels for individual light or color control (e.g., FIG. 2 depicts three power channels). In some cases, the light fixture 105 can receive inductive power through an external surface of the light fixture 105. Power to the light segment 100 can be activated manually (e.g., with a manual switch), wirelessly (e.g., the light segment 100 receives a wireless communication to power on), or automatically (e.g., as in the induction charging case). An above view of power contacts for the power input 140 are shown in FIG. 4, according to an embodiment of the invention.

Figure 3:
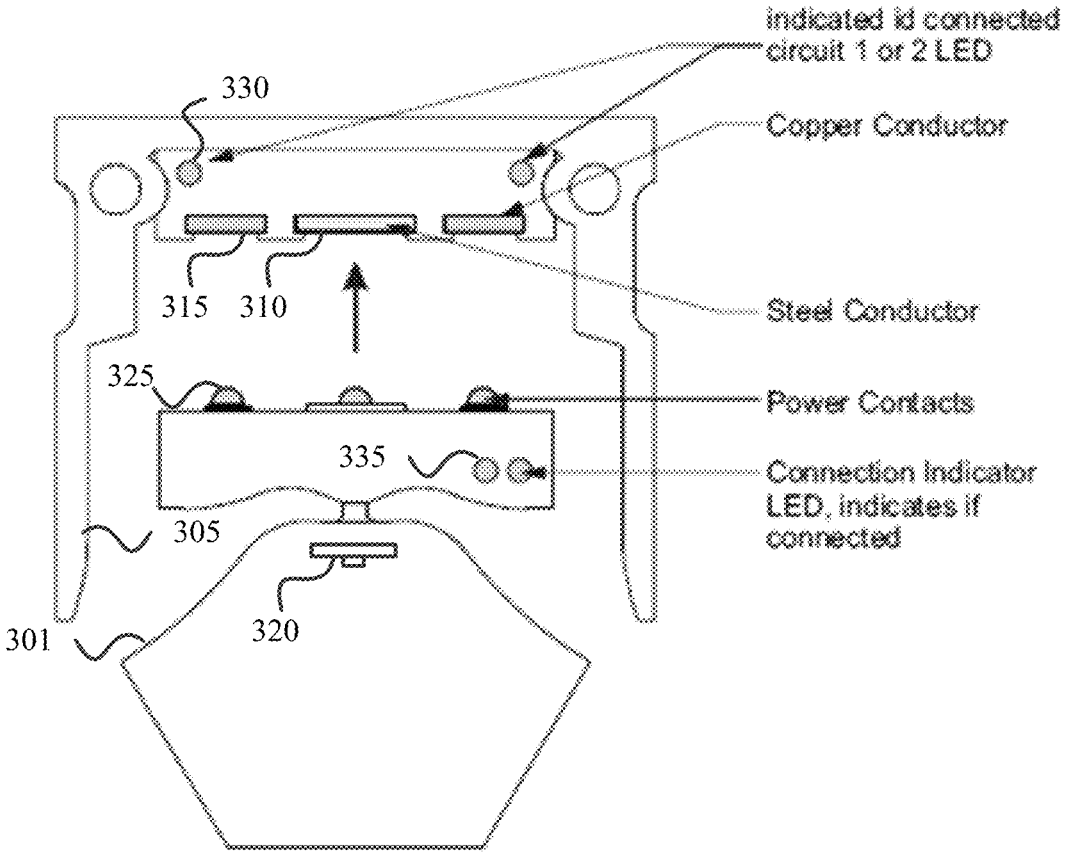
FIG. 3 depicts an installation track for attachment and removal of light segments, according to an embodiment of the claimed invention.
Figure 5A:
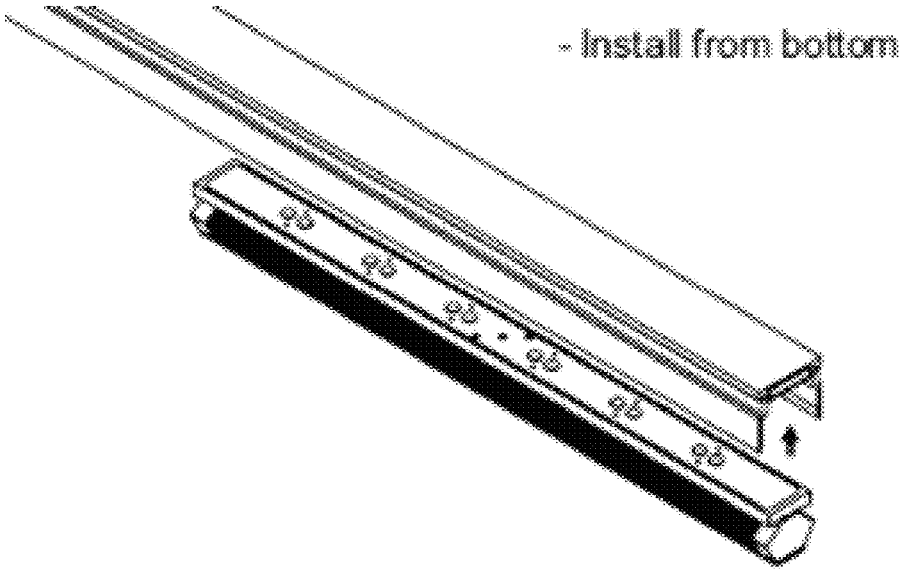
FIGS. 5A and 5B illustrate mounting configurations for attaching a light segment to an installation track, according to embodiments of the claimed invention.
Figure 5B:
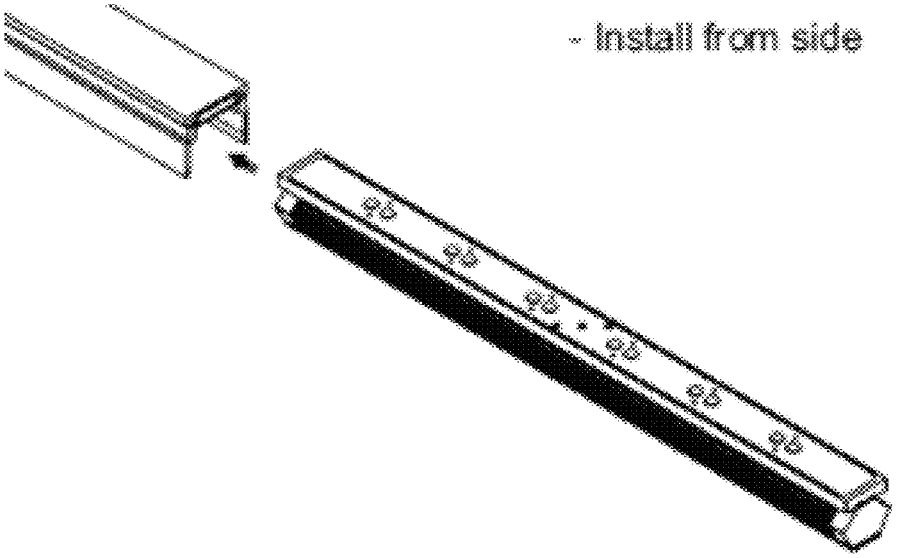

The light segment 100 can also include a mounting configuration 145 to attach the light segment to an installation track (e.g., installation track 300 as discussed in FIG. 3). The mounting configuration can include a set of clips or snap mechanisms for clipping the light segment onto the installation track, where the installation track includes corresponding clip receiver points (e.g., a recess where the clips can lock into place). Alternatively, the mounting configuration 145 can include a magnetic portion (e.g., on the exterior surface of the light fixture 105) that can be coupled to another magnetic source located on the installation track. FIGS. 5A and 5B illustrate embodiments of mounting configurations 500-*a* and 500-*b* for attaching a light segment to an installation track. For example, mounting configuration 500-*a* allows for the light segment to be attached to an installation track from the bottom (e.g., by clipping the light segment through clips or by magnetic attachment, etc.). As another example, mounting configuration 500-*b* allows for a light segment to be attached to an installation track from the side (e.g., by sliding the light segment on guiding surfaces of the installation track, etc.).

The light source can in some cases include various attachments which can affect the projected light originating from the light source, of the structure of the light source. These various attachments are illustrated in FIG. 2. For example, in some cases a beam angle modifier 210 can be attached to the light source 220, which can be an example of light source 120 described in FIG. 1. The beam angle modifier 210 can receive light projected from the light source 220 (e.g., in some cases, through the reflector or lens 245) and modify the angle the light is projected from the light segment 200, which can be an example of light segment 100 discussed in FIG. 1. Additionally or alternatively, a color filter 215 can be attached to the light source 220. The color filter 215 can receive light originating from the light source 220 and alter the color of the projected light transmitted from the light segment 200. Additionally or alternatively, a diffuser lens 230 can be attached to the light source 220. The diffuser lens can receive light originating from the light source 220 and diffuse the light transmitted from the light segment 200. The diffuser lens can be an example of diffuser lens 130 described in FIG. 1. Additionally or alternatively, a baffle 235 can be attached to the light source 220. The baffle 235 can secure the light source 220 within the light fixture 205, which can be an example of light fixture 105 described in FIG. 1. The beam angle modifier 210, color filter 215, diffuser 230, and/or the baffle 235 can be attachable and removable (e.g., via clips, a threaded socket, magnetic surfaces 240 as shown in FIG. 2, etc.) from the light fixture 205, thereby allowing a user access to inner portions of the light source 220.

FIG. 3 provides an illustration of an installation track 300 for attachment and removal of light segments, according to an embodiment of the claimed invention. The installation track 300 can also include a support structure 305. The support structure 305 can increase rigidity to the installation track 300. In some cases, the support structure 305 can at least partially support the weight and positioning of a light segment 301 attached to the installation track 300. Light segment 301 can be an example of light segment 100 and/or light segment 200, as described in FIGS. 1 and 2, respectively.

The installation track 300 can provide an attachment configuration 310 to attach the light segments. The attachment configuration 310 can be configured to receive or couple to the mounting configuration of the light segment 100. For example, the attachment configuration 310 can include a recess for receiving a set of clips of the light segment 301, or alternatively can include a set of clips that can be received by the light segment 301. In another example, the attachment configuration 310 can include a magnetic strip that can couple to a corresponding magnetic portion of the light segment 301. An example embodiment illustrated in FIG. 3, the attachment configuration 310 includes a steel conductor that can be matched to the corresponding mounting configuration of the light segment 301.

The installation track 300 can also include a power output 315 that can couple to the light segment 301. The power output 315 can provide power to the light source 320, and other features, of the light segment 301 through a corresponding power input 325 of the light segment 301. For example, the installation track 300 can include female connectors for providing power (e.g., from a power mains). Alternatively, the installation track 300 can include male connectors (e.g., prongs) for outputting power. In some cases, the installation track 300 can provide battery-operated power. In some cases, the installation track 300 can transfer inductive power through an external surface of the installation track 300. Power to the light segment 301 can be activated manually (e.g., with a manual switch), wirelessly (e.g., the installation track 300 receives a wireless communication to power on), or automatically (e.g., as in the induction charging case). In some cases, the system can also transmit sensor data from a sensor module mounted on the track (e.g., to a remote computer, server, etc.). An example embodiment illustrated in FIG. 3, the power output 315 includes multiple of copper and/or steel conductors for supplying multiple-channeled power to the light segment 301 via the power input 325 (e.g., the power contacts).

The installation track 300, the light segment 301, or both, can include a visual indicator notify a user that the light segment 301 is correctly attached to the installation track 300. For example, the installation track 300 can include a circuit connection indicator 330. The circuit connection indicator can display whether the light segment 301 is connected to a circuit of the installation track 300. In some cases, the installation track can output power to different completed circuits (e.g., when multiple light segments 301 are attached to the installation track 300). The circuit connection indicator 330 can display which, if any, of the circuits an attached light segment 301 is connected to. An example circuit connection indicator 330 can include a set of lights, where each light represents an individual, completed circuit. A light can emit light when a light segment 301 is properly connected to the associated circuit (e.g., completing the circuit). The light segment 301 can also include a connection indicator 335, which can act similarly to the circuit connection indicator 330. The connection indicator 335 can light up when the light segment 301 is properly connected to the installation track 300 (e.g., completes a circuit) and is receiving power from the installation track 300.

Figure 6:
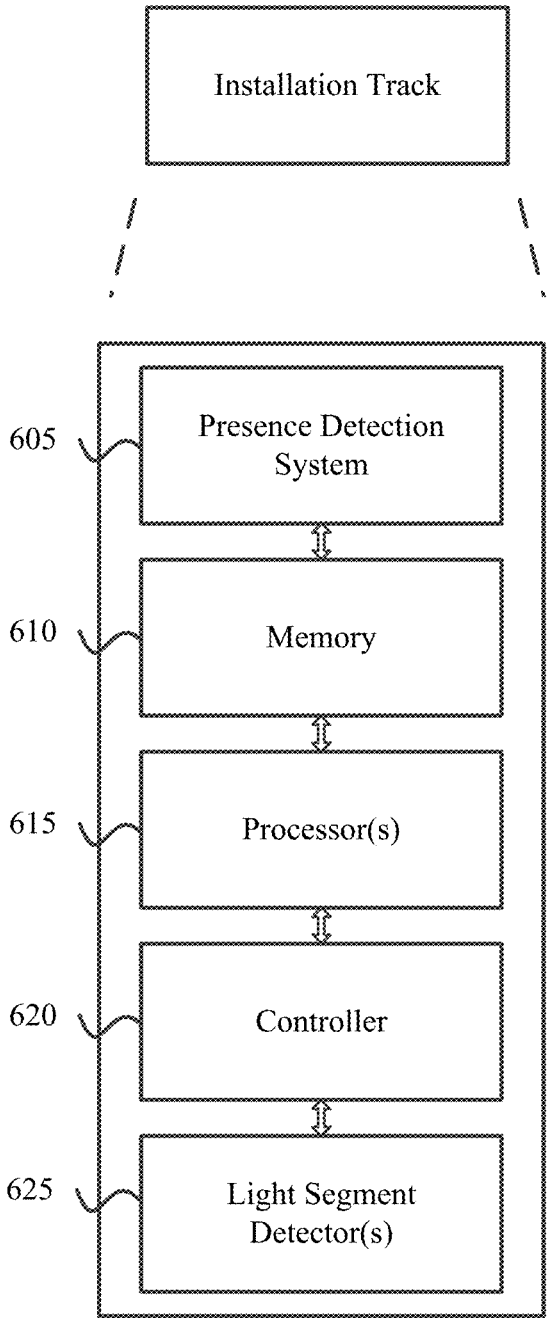
FIG. 6 depicts an installation track for attachment and removal of light segments, according to an embodiment of the claimed invention.

FIG. 6 illustrates a installation track 600, according to an embodiment of the claimed invention. The installation track can be an example of the installation track 300 of FIG. 3, and can be configured to couple to a plurality of light segments, such as light segment 100 of FIG. 1.

The installation track 600 can also include a presence detection system 605. The presence detection system 605 can identify a presence of an individual in close geographical proximity to the installation track 600. For example, the presence detection system 605 can include a motion detector that can detect movement within a predefined geographical range of the installation track 600. Additionally or alternatively, the presence detection system 605 can include biological detectors, such as biothermal sensors, cameras, light sensors, facial recognition sensors, audio sensors, and the like. In some cases, the light system can alter the output of a light segment based on sensor data. For example, the light system can increase the light output of one light semgment when the system detects an individual near the system.

The presence detection system 605 can log information pertaining to individual detection within memory 610 of the installation track 600. For example, when the presence detection system 605 identifies the presence of an individual, the presence detection system 605 can log a date, a time, a number of people detected, a time duration of detected presence, an exit time for the detected presence, or a combination thereof, within the memory 610 of the installation track 600. In some cases, the memory 600 is stored remotely (e.g., in a server, computing device, database, etc.), where the installation track 600 communicates the storable information to the memory 600 (e.g., via wired or wireless communications).

The installation track 600 can also include a set of processors 615. The processors 615 can calculate various analytics based on the stored information from the presence detection system 605. For example, the processors 615 can calculate peak traffic times, low traffic times, optimal energy-efficiency lighting configurations, or a combination thereof, for the installation track 600 based on the stored information. These calculated analytics can also be stored in the memory 600 of the installation track 600.

The installation track 600 can also include a controller 620 that controls the light segments 100 attached to the installation track 600. For example, the installation track 400 can include a set of light segment detectors 625 that can detect the connection of a light segment (e.g., light segment 100) to the installation track 600. The light segment detectors 625 can transmit information associated with the connection to the controller 620. The controller 620 can then control characteristics of the light segment 100 based on the detected connection. For example, the controller 620 can control the power output provided to the light segment 100, when to turn the light source of the light segment 100 on or off, a color scheme of the light segment 100, and so forth. The controller's 620 actions can further be based on the logged presence information and/or the calculated analytics stored in the memory 610.

Figure 7:
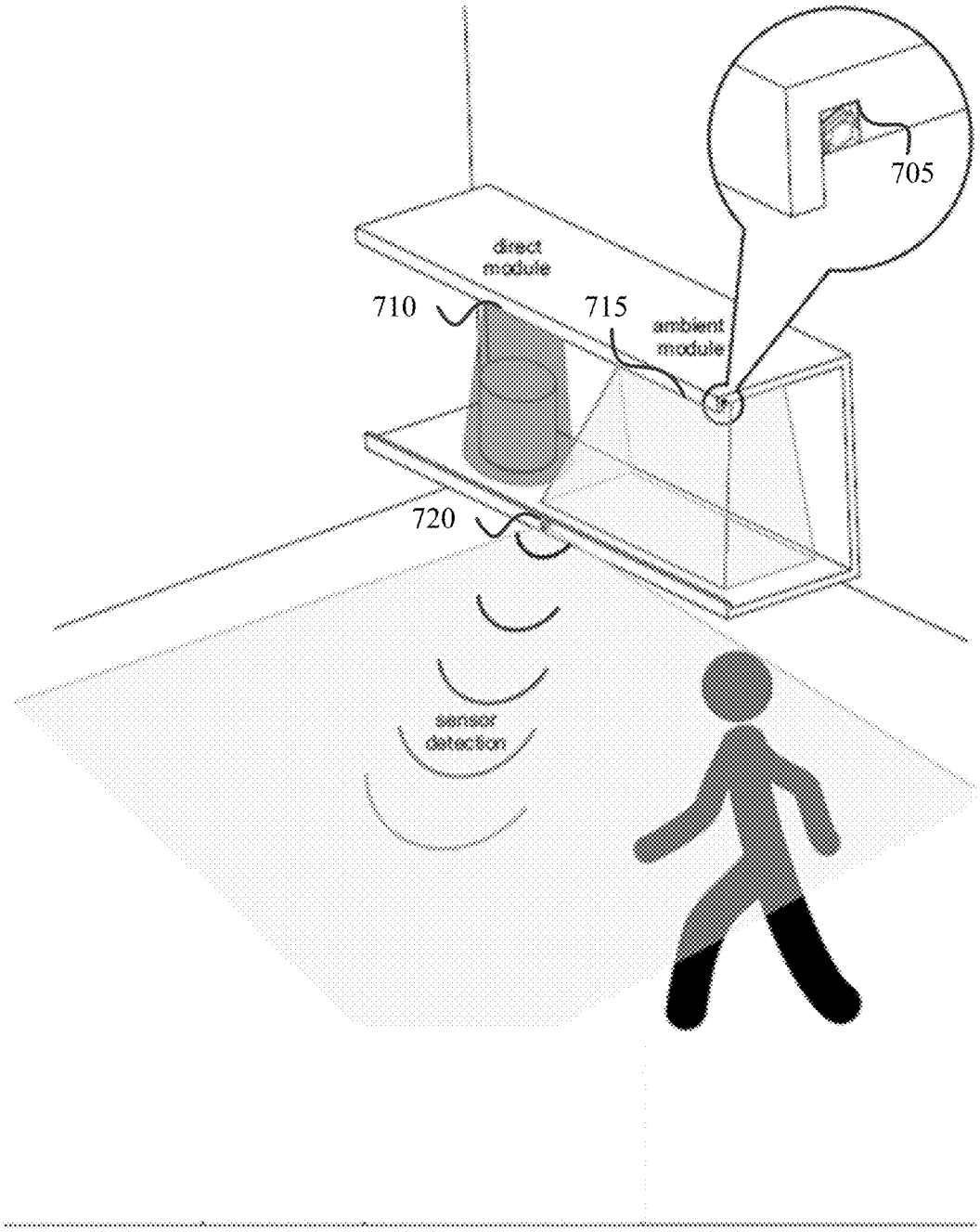
FIG. 7 depicts a system for attachment and removal of light segments, according to an embodiment of the claimed invention.

An exemplary embodiment of a modular lighting system 700 for attaching and removing light segments is illustrated in FIG. 7. The system 700 can include an installation track 705, such as the installation tracks 200, 300, and/or 600 as described in detail with reference to FIGS. 2,3, and 6. The system 700 can also include at least one light segment, such as the light segment 100 as described with more detail with reference to FIG. 1.

The installation track 705 of the system 700 can be connected to or installed to a ceiling or wall of a room. In this particular instance, the installation track 705 is installed into an overhang of a display shelf. The display shelf can hold a variety of items for display, such as a purse, a vase, or any other item that fits within the confines of the display shelf. The installation track 705 is located above any such display items.

Figure 8:
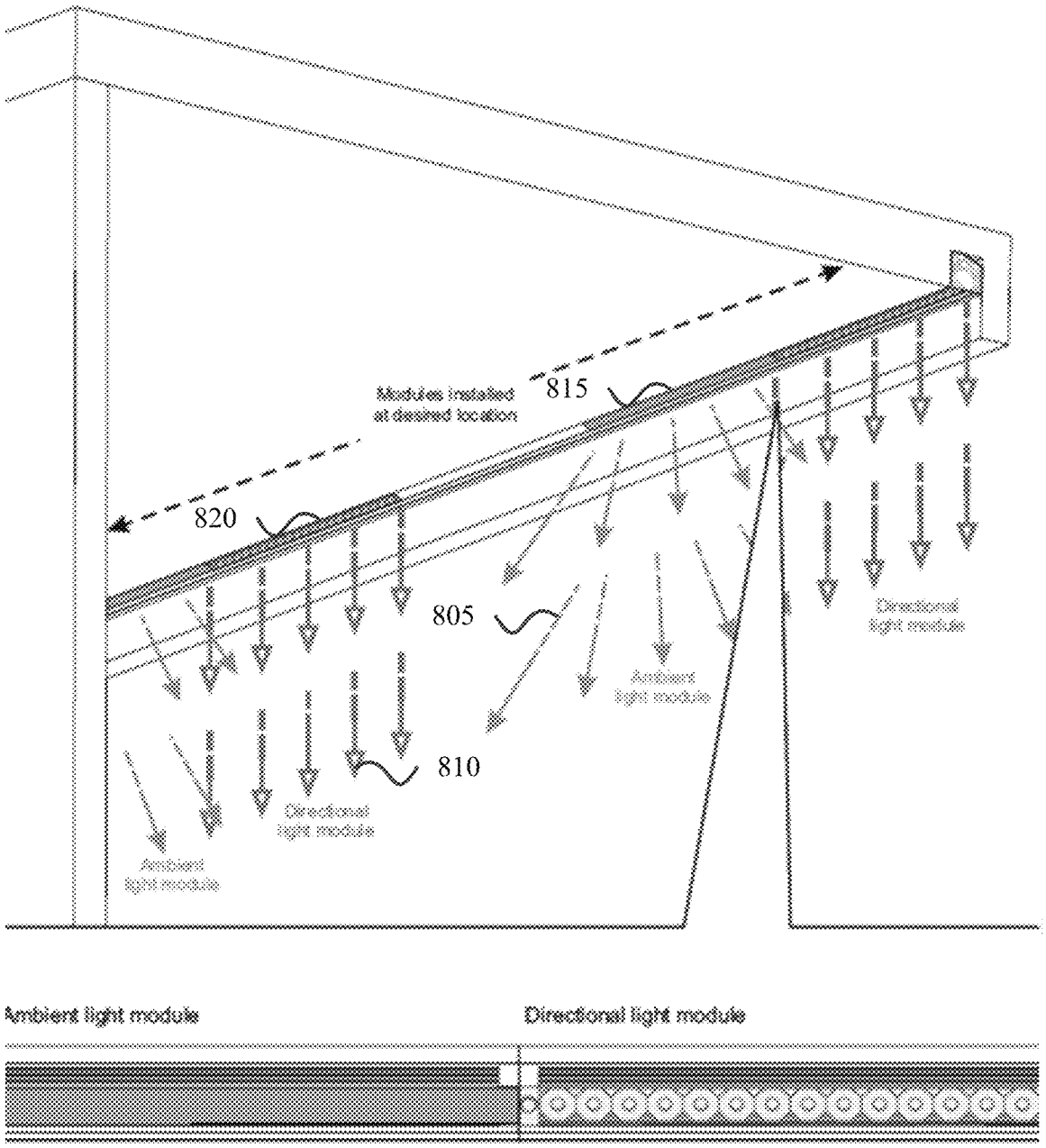
FIG. 8 illustrates an exemplary embodiment of a system for attachment and removal of light segments, according to an embodiment of the claimed invention.

The installation track 705 can include multiple connectors and power supply outputs for a light segment to be attached to. In some instances the multiple connectors and power supply output run continuously along the length of the installation track 705. A user of the system 700 can attach a light segment to the installation track wherever a connector and power supply outlet is available. Further, a user can attached multiple light segments to the installation track. An example of ambient and directional light projected from directional and ambient light segments connected to an installation track is illustrated in FIG. 8, where the ambient light 805 emitted from ambient light sources 815 will be more dispersed with reduced intensity as compared to the directional light 810 emitted from directional light sources 820.

Further, the user can select the type of light segment to use based on user preference. For example, as shown, the system 700 includes a directional light segment (e.g., a 25 degree spot segment 710). The 25 degree spot segment 710 is attached to the installation track 705 and positioned to project directional light onto the displayed object. Additionally, an ambient light segment (e.g., a 90 degree flood segment 715) can be attached to the installation track and positioned to project ambient light onto the back wall of the display shelf.

In the case that user light preferences change (e.g., the displayed items have moved or have been replaced, the user prefers different lighting styles or colors, etc.) the user can simply detach a light segment from the installation track 705, reposition the light segment, add another light segment, or a combination thereof, to the system 700. The system 700 therefore provides an efficient and seamless solution for light integration into various configurations based on user preference.

In some cases, the system 700 can also include sensors 720 for detecting the presence of individuals, and memory to store data associated with the detected presence as discussed with reference to FIG. 6. For example, the system 700 can log the number of people that stand in front of the display shelf, and can include the time and how long the individual's presence was detected. The system 700 can store this information in memory either located within the system 700 or remotely (e.g., connected to a user computer, server, database, etc.) The system 700 can also calculate analytics based on the logged information, such as peak traffic times, etc.

Additionally, the system 700 can include computer hardware and software for automating the use of the light segments. For example, the system can be configured to turn on the directional light segments when an individual's presence is detected. As another example, the ambient light segment can be turned on during night hours, or turned off during business closure hours (e.g., times that are inputted into the hardware by a user, or times determined by the system 700 based on a lack of presence detected for a predetermined period of time, etc.). As another example, the system 700 can adjust the color or light output based on sensor data over time, throughout the day, etc.)

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A modular lighting system, comprising:

a first LED light segment adapted or configured to produce ambient light;

a second LED light segment adapted or configured to produce directional light;

an installation track adapted or configured to connect to the first LED light segment and the second LED light segment along a length of the installation track;

a power source adapted or configured to provide power, via the installation track, to the first LED light segment and the second LED light segment when the first LED light segment and the second LED light segment are connected to the installation track;

wherein the first LED light segment and the second LED light segment are further adapted or configured to be separately controllable and positionable along the length of the installation track.

2. The modular lighting system of claim 1, wherein the first LED light segment further comprises a diffuser or a lens.

3. The modular lighting system of claim 1, wherein the second LED light segment further comprises a reflector or a lens.

4. The modular lighting system of claim 1, further comprising:

a sensor adapted or configured to sense a connection between the installation track and the first LED light segment, the second LED light segment, or both; and a controller adapted or configured to control a light output of the first LED light segment, the second LED light segment, or both, based on the sensed connection.

5. The modular lighting system of claim 4, wherein the sensor is further adapted or configured to sense a condition associated with the modular lighting system; and wherein the controller is further adapted or configured to control the light output of the first LED light segment, the second LED light segment, or both, based on the sensed condition.

6. The modular lighting system of claim 1, further comprising:

a motion detector adapted or configured to detect an individual within a predefined geographical range of the modular lighting system; and a controller adapted or configured to control a light output of the first LED light segment the second LED light segment, or both, based on the detected individual.

7. The modular lighting system of claim 6, further comprising:

a processor;

memory; and instructions executable by the processor to:

determine when the motion detector has detected motion; and log the detected motion in the memory.

8. The modular lighting system of claim 1, further comprising a display case adapted or configured to couple to the installation track.

9. The modular lighting system of claim 1, wherein the first LED light segment, the second LED light segment, or both, are further adapted or configured to produce directable light.

10. The modular lighting system of claim 1, wherein the wherein the first LED light, the second LED light, or both, are further adapted or configured to connect magnetically to the installation track.

* * * * *